US005443693A

United States Patent [19]

Inoue et al.

[11] Patent Number: 5,443,693

[45] Date of Patent: Aug. 22, 1995

[54] METHOD OF RECOVERING COMPONENTS FROM COKE OVEN GASES USING PREDICTIVE TECHNIQUES

[75] Inventors: Shinichi Inoue; Katsutoshi Abeyama; Fuminori Munekane; Hisanobu Watanabe; Yasuyuki Misake, all of Kagawa, Japan

[73] Assignee: Mitsubishi Kasei Corporation, Tokyo, Japan

[21] Appl. No.: 47,350

[22] Filed: Apr. 19, 1993

Related U.S. Application Data

[63] Continuation of Ser. No. 254,922, Oct. 7, 1988, abandoned.

[30] Foreign Application Priority Data

Oct. 12, 1987 [JP] Japan ..... 62-254700

[51] Int. Cl.[6] ..... G01D 1/00

[52] U.S. Cl. ..... 201/1; 364/571.04; 364/571.05

[58] Field of Search ..... 201/1; 364/51.04, 571.05

[56] References Cited

U.S. PATENT DOCUMENTS 3,515,343 6/1970 Schwartzenberg et al. ... 364/571.05

FOREIGN PATENT DOCUMENTS 57-121088 7/1982 Japan .
60-173088 9/1985 Japan ..... 201/1
60-240789 11/1985 Japan ..... 201/1
62-53393 3/1987 Japan ..... 201/1

OTHER PUBLICATIONS

Box et al. "Time Series Analysis Forecasting and Control", Publ. by Holden-Day, (1968), pp. 7-10, 46-54 and 265-267. (Excerpts).

*Primary Examiner*—W. Gary Jones
*Assistant Examiner*—Mark De Simone
*Attorney, Agent, or Firm*—Cushman, Darby & Cushman

[57] ABSTRACT

A method for recovering a component from gas that is produced by a coke oven battery. The total amount of gas that will be produced by the coke oven battery is predicted by determining a quantity of coal charged, and determining variations of a production rate of the gas. Therefore, a prediction value of gas to be produced is made based on the quantity of coal and the determined variations. An error is determined between the actually-measured value of gas and a prediction value. The prediction value for that and other times is corrected. Based on this prediction value, gas recovery conditions for the coke oven gas are controlled.

5 Claims, 1 Drawing Sheet

METHOD OF RECOVERING COMPONENTS FROM COKE OVEN GASES USING PREDICTIVE TECHNIQUES

This is a continuation of application Ser. No. 07/254,922, filed on Oct. 7, 1988, which was abandoned upon the filing hereof.

BACKGROUND OF THE INVENTION a) Field of the Invention

The present invention relates to a method for predicting the total amount of gas to be produced from a coke oven battery.

b) Description of the Prior Art

A coke oven battery used for producing coke generally consists of a plural number of coke ovens. In order to produce coke with the coke oven battery, coal is charged as the raw material into the coke ovens sequentially at definite time intervals and coke is discharged sequentially after production. In such a coke oven battery, gas is produced from the individual coke ovens. The produced gas is collected from the coke oven into a duct for discharge outside the oven.

The gas produced in the coke oven battery contains gas oils such as benzene and toluene as well as other components, which are recovered for utilization by a process, for example, of desulfurization or gas oil recovery, whereas remaining coke oven gas (COG) which is not recovered is utilized as a fuel.

When COG production rate from a coke oven battery varies, it is possible to enhance recovering efficiency by controlling conditions in the process to recover the above-mentioned components in accordance with the variation of the production rate or when the COG is to be used as a fuel, it may be necessary to control feed rate in accordance with production rate so as to keep good balance between demand and supply.

For this reason, it is important to predict amount of gas to be produced from the coke oven battery.

As the conventional method, it is already known to predict total amount of gas to be produced from a coke oven battery by preliminarily determining a unit quantity of coal charged into each coke oven and empirically (or experimentally) determining parameters of variation with time lapse of production rate per unit quantity of coal at the stages from charging of coal to discharge of coke. Speaking concretely, on the basis of actual achievements, production rate $q_0$ per unit quantity of charged coal at the charging time, production rate $q_1$ at time $t_1$ after charging, . . . and production rate $q_n$ at time $t_n$ after charging or at the discharging time are used as quantity of coal charged at time $t_n$ before the present the parameters on the basis of actual achievement, whereas time is represented by $W_{-n}$, quantity of coal charged at time $t_{n-1}$ before the present time is designated by $W_{-(n-1)}$, . . . and quantity of coal charged at the present time is denoted by $W_0$ as shown in FIGS. 4 and 5. Then, a total amount of produced COG is determined by the following equation:

$$W = W_0 q_0 + W_{-1} \cdot q_1 + \ldots + W_{-n} \cdot q_n$$

However, it is impossible to correctly predict a total amount of COG by this method since gas production rate per unit quantity of charged coal is varies depending on variations of various conditions such as operating condition of the coke oven battery and quality of charged coal. Accordingly, it is necessary to perform calculations for prediction with the parameters and production model corrected or modified in accordance with the variations of the coking conditions, thereby making it necessary to collect a large quantity of data and prepare the parameters and productions models based on data while consuming a long time and a large amount of labor.

The predicting methods disclosed by Japanese Unexamined Published Patent Applications No. 240789/60 and No. 121088/57 are known as the conventional examples but have the above-described defects that sufficiently satisfactory prediction is impossible.

SUMMARY OF THE INVENTION

A primary object of the present invention is to provide a method permitting prediction of the total amount of gas to be produced from a coke oven battery including variation of production rate due to variations of operating conditions, etc. of coke ovens simply by inputting data as a specific model, and accordingly always capable of accurately predicting a total amount of COG to be produced from a coke oven battery.

The method for predicting total the amount of coke oven gas to be produced according to the present invention is based on a unit quantity of coal to be charged into a plural number of coke ovens composing a coke oven battery, an equation expressing total amount of gas to be produced from the coke oven battery on the basis of variation with time lapse at the stages from charging of coal to discharge of coke and an equation for estimating an error of predicted total amount on the basis of past prediction value of total production amount determined by said equation, and is so adapted as to predict total amount of gas to be produced while sequentially correcting the parameters in the former equation by giving new quantities of charged coal and actually measured amounts of produced gas for each prediction of total amount of gas to be produced. Accordingly, the method according to the present invention has made it possible to always predict a correct total amount by sequentially correcting the parameters with newly given data even when operating conditions, etc. of coke ovens are varied.

DETAILED DESCRIPTION OF THE PREFERRED EMBODIMENTS

Now, the method for predicting a total amount of gas to be produced from a coke oven battery according to the present invention will be described in detail with reference to concrete equations expressing amount of gas to be produced and error of prediction respectively.

Figure 1:
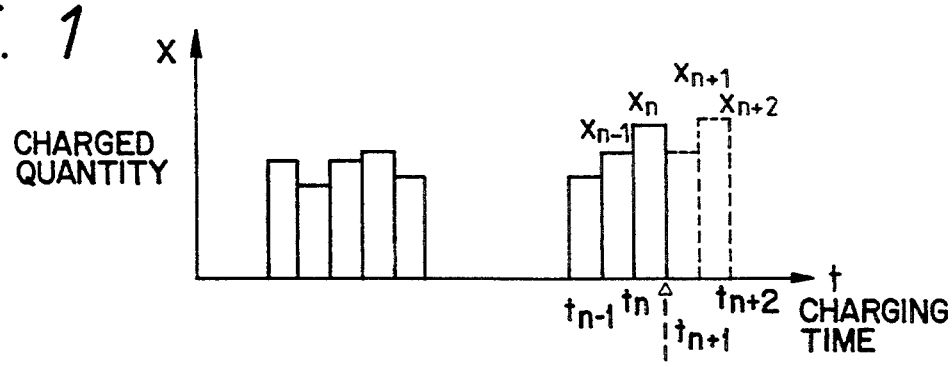
FIG. 1 through FIG. 3 show bar graphs descriptive of the predicting method according to the present invention.

In FIG. 1 the abscissa represents time and the ordinate represents quantity of coal charged into a coke oven battery. Speaking more concretely, quantity of coal charged at the present time $t_n$ is represented by $x_n$, quantity of coal charged at time $t_{n-1}$ is designated by $x_{n-1}$, . . . and quantity of coal charged at time $t_0$ is denoted by $x_0$.

Figure 2:
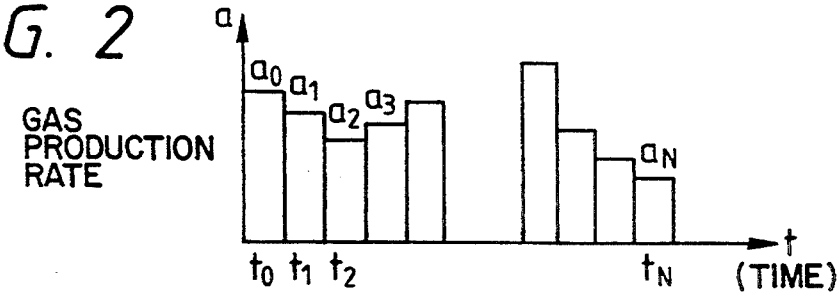

FIG. 2 shows a bar graph wherein the abscissa represents time, the ordinate represents amount of coke oven gas produced per unit quantity of charged coal, charging time is designated by $t_0$, and gas production rates per unit quantity of charged coal upon time lapses of $t_1$, $t_2$, . . . $t_N$ after the charging time $t_0$ are denoted by $a_0$, $a_1$, $a_2$, . . . $a_N$ respectively. That is to say, FIG. 2 illustrates variations of gas production rate with time lapse after charging of coal.

Figure 3:
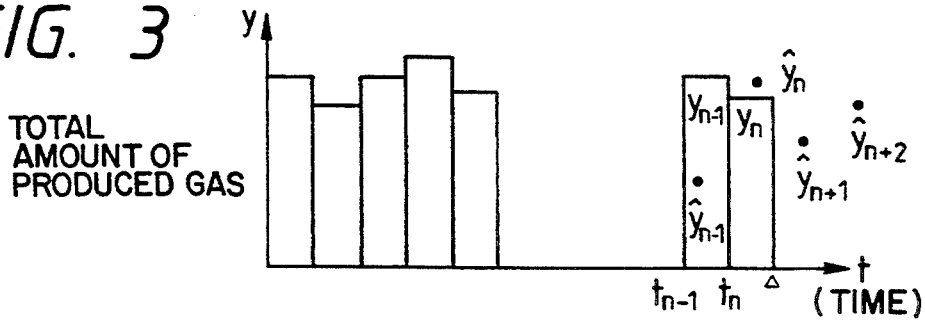
Figure 4:
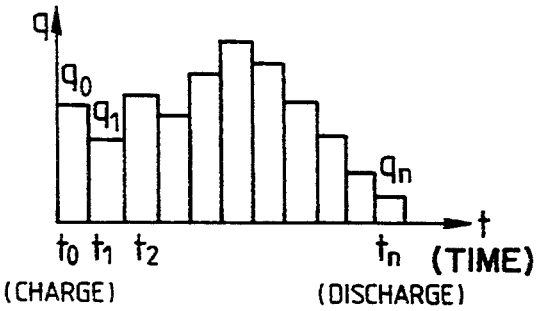
FIG. 4 (PRIOR ART)
FIG. 4 and FIG. 5 show bar graphs descriptive of the conventional predicting methods.
Figure 5:
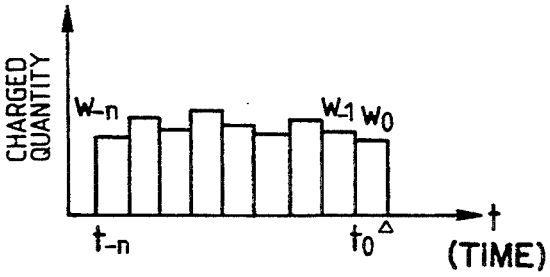
FIG. 5 (PRIOR ART)

In FIG. 3, the abscissa represents time, the ordinate represents total amounts of produced gas, the bars represent actually measured values and the marks · represent predicted values.

Referring to the FIG. 1 through FIG. 3, the operation will be described below time, i.e. $t_n$, is expressed by the following equation:

$$y_n = a_0 \cdot x_n + a_1 \cdot x_{n-1} + \ldots + a_N \cdot x_{n-N} + e_n \quad (1)$$

In other words, amount of gas produced from the unit quantity of coal charged at time $t_n$ is expressed as a product of $x_n$ multiplied by $a_0$ which is the production rate just after the charging of coal and amount of gas produced from the unit quantity of coal charged at time $t_{n-1}$ is expressed as a product of $x_{n-1}$ multiplied by $a_1$ which is the production rate at time $t_1$ after charging. Similarly, the amount of gas produced from the coal charged in quantity $x_{n-N}$ upon time lapse of $t_N$ is $a_N \cdot x_{n-N}$. Therefore, total amount $y_n$ of gas which has been produced by the present time is expressed by the above-mentioned equation (1). The reference symbol $e_n$ represents noise (error). That is to say, prediction value $\hat{y}_n$ of total gas amount at the present time is expressed as follows:

$$e_n = y_n - \hat{y}_n$$

Similarly, total gas production amounts at times $t_{n-1}$, $t_{n-2}$, . . . are expressed by the following equations (1'):

$$\begin{aligned} y_{n-1} &= a_0 \cdot x_{n-1} + a_1 \cdot x_{n-2} + \ldots + a_N \cdot x_{n-1-N} + e_{n-1} \\ y_{n-2} &= a_0 \cdot x_{n-2} + a_1 \cdot x_{n-3} + \ldots + a_N \cdot x_{n-2-N} + e_{n-2} \\ y_{n-3} &= \ldots \end{aligned} \quad (1')$$

wherein the reference symbols $e_{n-1}$, $e_{n-2}$, . . . also represent errors.

Since the charged quantities $x_n$, $x_{n-1}$, . . . and total production amounts $y_n$, $y_{n-1}$, . . . are known in these equations (1) and (1'), it is possible from these equations to calculate $a_0$ through $a_N$ giving a minimum $e_n^2$ by the least squares method.

Assuming that the noises components (errors) $e_n$, $e_{n-1}$, . . . are the components produced from the auto regression process (AR process), these noises are expressed by the following equations (2):

$$\begin{aligned} e_n &= -b_1 \cdot e_{n-1} - b_2 \cdot e_{n-2} \ldots + W_n \\ e_{n-1} &= -b_1 \cdot e_{n-2} - b_2 \cdot e_{n-3} \ldots + W_{n-1} \\ e_{n-2} &= \ldots \\ &\ldots \end{aligned} \quad (2)$$

wherein the reference symbols $W_n$, $W_{n-1}$, . . . are the white noises, and the reference symbols $b_1$, $b_2$, . . . are the parameters.

$e_n$ can be determined by calculating $b_1$ through $b_n$ from the equation (2) so as to obtain a minimum value of $W_n^2$ by the least square method.

A production amount can be expressed by adding the production amount $y_n$ to error $e_n$ as expressed by the following equation (3):

$$y_n = \sum_{i=0}^{N} a_i \cdot x_{n-1} = \sum_{j=1}^{m} b_j (y_{n-j} - \hat{y}_{n-j}) \quad (3)$$

On the basis of the equation (3), a prediction value $\hat{y}_{n+1}$ is calculated by the following equation (4):

$$\hat{y}_{n+1} = \sum_{i=0}^{N} a_i \cdot x_{n-i+1} - \sum_{j=1}^{m} b_j (y_{n-j+1} - \hat{y}_{n-j+1}) \quad (4)$$

The reference symbol $x_{n-1}$ used in the equation (4) represents the scheduled quantity of coal to be charged next which is a known variable since an operating schedule for several hours to more than ten hours is generally determined for a coke oven battery.

As the time span ranging from the time $t_0$ to the time $t_n$ used in the foregoing description, it will be adequate to select an approximate coking time, for example, of 19 hours. Further, the time interval between $t_0$ and $t_1$ is a predicting frequency which may be set, for example, at 30 minutes or one hour. In addition, as the dimension m of the noise components, an adequate value should be selected from among the information quantity standard (FPE: Final Prediction Error, AIC: Akaike Information Criterion), predicting accuracy and so on. It is conceivable to select m=5 for general coke ovens battery.

The embodiment of the present invention described above permits accurately predicting coke oven gas to be produced by using $a_0$, $a_1$, $a_2$, . . . as parameters, determining these parameters so as to minimize errors by the least square method and determining the parameters $b_1$, $b_2$, . . . representing .error components also so as to minimize the normal white noise series Wi. Accordingly, the embodiment permits very accurate prediction regardless of variations in operating conditions of a coke oven since it determines the next prediction value by inputting the quantity of coal to be charged next and new actually measured values.

The embodiment described above with reference to concrete equations can be expressed by the following simplified general equation (5):

$$\hat{y}_{n+1} = f(a_i, x_i) + g(b_i, y_i, \hat{y}_i) \quad (5)$$

It is possible to determine a prediction value $\hat{y}_i$ at each time by determining the parameters $a_i$ and $b_i$ on the basis of known $x_i$ and $y_i$ respectively in the equation (5). Further, prediction is performed while consecutively correcting the equation expressing prediction value by gradually correcting new charging quantity $x_i$, actually measured value $y_i$ and so on.

On the basis of the equation expressed as a total sum of production amount and errors including parameters respectively, it is possible to predict total gas amount to be produced from a coke oven battery with a computer by carrying out calculations while inputting known values of charged coal quantities, actually measured values of produced gas amounts and so on. Moreover, the present invention permits very accurate prediction of values including variations of production rate due to variations of conditions in a coke oven battery since the method calculates total production amount while correcting the parameters by sequentially inputting known data newly obtained.

In the foregoing description, quantities of charged coal are used as the input values for predicting coke oven gas to be produced. It is conceivable to use, as input values for accurate prediction of total amount of gas to be produced from a coke oven battery, properties of coal, for example, volatile components, ash and moisture in addition to quantities of coal. However, test results indicated no substantial difference in prediction accuracy between cases where properties of coal were used as input values and other cases where such input values were not used.

As in understood from the foregoing description, the method for predicting total amount of gas to be produced from a coke oven battery according to the present invention permits very accurate prediction since it performs prediction by calculations based on data obtained during coking process and taking error components into consideration, and makes it possible to perform accurate prediction despite variations of coking conditions since it performs calculations while gradually correcting the parameters by adopting new data with lapse of time.

We claim:

1. A method of recovering at least one component from coke oven gas that is produced by a coke oven battery that includes a plurality of coke ovens with a plurality of carbonization chambers, by controlling operating conditions of recovery of said at least one component from coke oven gas in response to the amount of coke oven gas which is predicted to be produced by the coke oven battery, said method comprising the steps of:

a) determining a quantity of coal charged into each coke oven of said battery and determining variations of gas production rate during the time from charging of coal to discharge of coke in the entire battery, b) determining a prediction value of gas to be produced from the coke oven battery based the determined quantities of charged coal and the determined variations in gas production rate, c) determining an error at an optional time between an actually measured value of amount of the gas produced from said coke oven battery during a definite time span in the past and a prediction value for the same time span, d) correcting the prediction value of step b) based on the error determined in step c), e) repeating prediction of the gas to be produced while correcting parameters by the operations at each of the said steps a, b, c and d based on the quantity of coal newly charged and the amount of produced gas actually measured at each time within the definite time intervals within said time span, and f) recovering said component and controlling recovering conditions when said component is being recovered from the coke oven gas based on said prediction of gas amount in step e), to most efficiently recover said at least one component of the gas.

2. A method as in claim 1 wherein said component is selected from the group consisting of benzene and toluene.

3. A method according to claim 1 wherein said determining a prediction value step is determined by the following equation (1):

$$y_n = a_0 \cdot x_n + a_1 \cdot x_{n-1} + \ldots + a_N \cdot x_{n-N} + e_n$$

wherein the reference symbol $x_n$ represents a quantity of coal charged at present time $t_n$, the reference symbol $a_N$ designates gas production rate at time $t_N$ and the reference symbol $e_n$ denotes an error at time $t_N$, and wherein each variable in the series represents these values for each of the coke ovens as they are sequentially charged.

4. A method according to claim 3 wherein said correcting a prediction value step further comprises the step of determining a correction value for a prediction value $y_n$ by calculating $a_0, a_1, \ldots a_N$ so as to obtain a minimum $e_n^2$ in said equation (1).

5. A method according to claim 4 wherein said determining an error step further comprises the step of determining an error $e_n$ by calculating parameters $b_1, b_2, \ldots b_n$ so as to obtain a minimum value of $W_i^2$ when the error $e_n$ is expressed by the following equation (2):

$$\begin{aligned} e_n &= -b_i \cdot e_{n-1} - b_2 \cdot e_{n-2} \ldots + W_n \\ e_{n-1} &= -b_i \cdot e_{n-2} - b_2 \cdot e_{n-3} \ldots + W_{n-1} \\ e_{n-2} &= \ldots \\ &\ldots \end{aligned} \quad (2)$$

wherein the reference symbol $W_n$ represents the normal white noise.

* * * * *